United States Patent [19]

Sanderson

[11] Patent Number: 4,669,290

[45] Date of Patent: Jun. 2, 1987

[54] APPARATUS FOR FORMING A BAFFLE

[76] Inventor: R. Malcolm B. Sanderson, P.O. Box 30403, Petone, New Zealand

[21] Appl. No.: 811,524

[22] Filed: Dec. 20, 1985

[30] Foreign Application Priority Data

Dec. 21, 1984 [NZ] New Zealand ..... 210732

[51] Int. Cl.[4] ..... B21D 28/28

[52] U.S. Cl. ..... 72/71; 72/186

[58] Field of Search ..... 72/70, 71, 96, 186; 83/30, 867

[56] References Cited

U.S. PATENT DOCUMENTS

| | | | |
|---|---|---|---|
| 2,185,337 | 1/1940 | Green | 72/71 |
| 2,999,525 | 9/1961 | Mercer | 72/71 |
| 3,156,285 | 11/1964 | Layne | 72/71 |
| 4,306,437 | 12/1981 | Javorik et al. | 72/96 |

*Primary Examiner*—Lowell A. Larson
*Attorney, Agent, or Firm*—Dorsey & Whitney

[57] ABSTRACT

A machine for creating louvers in piping or tubing which is supported from within and rotated about its longitudinal axis by a driving force. The louvers are created by a toothed die wheel and a cooperating anvil member which spirally perforates the wall of the tube or pipe.

7 Claims, 10 Drawing Figures

FIG 4
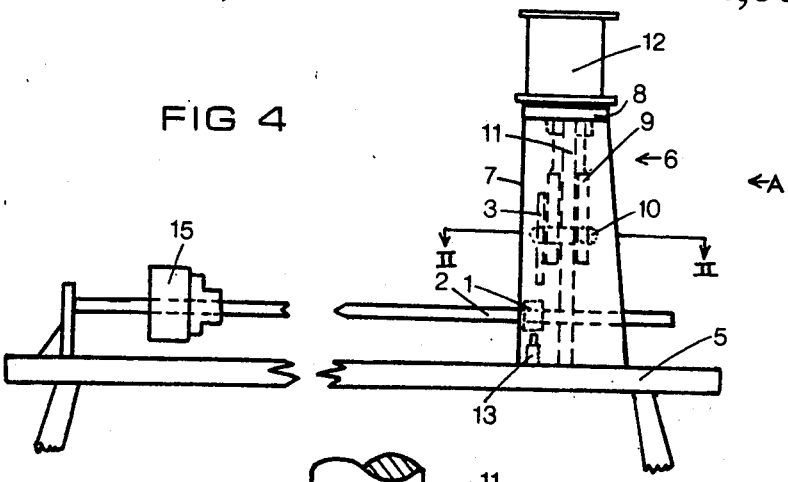
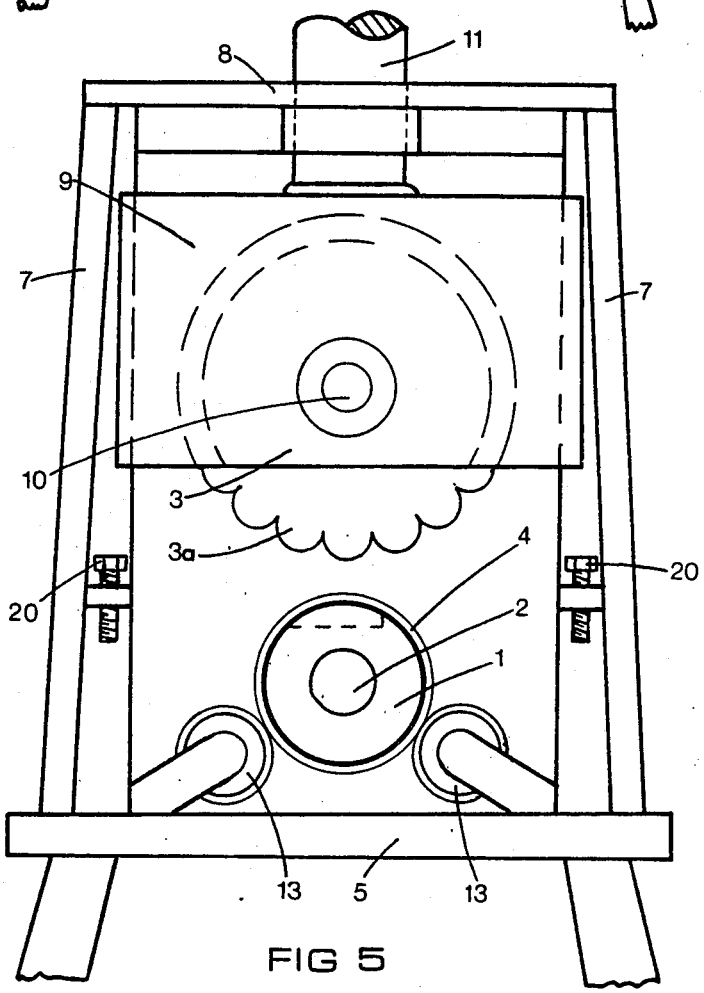
FIG 5

FIG 7
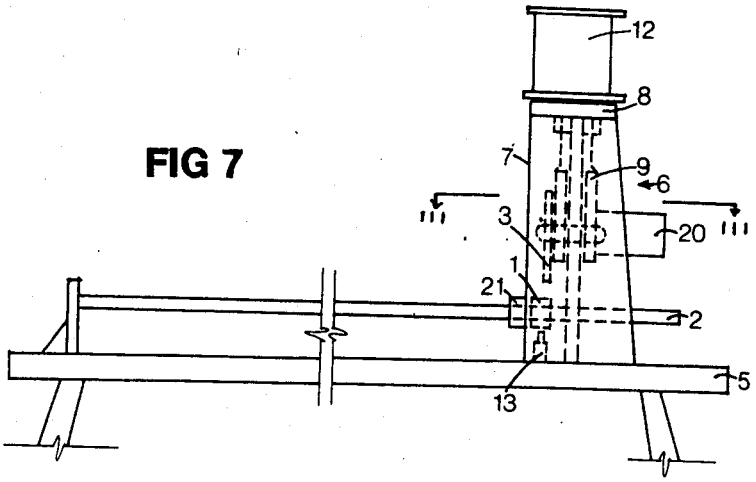
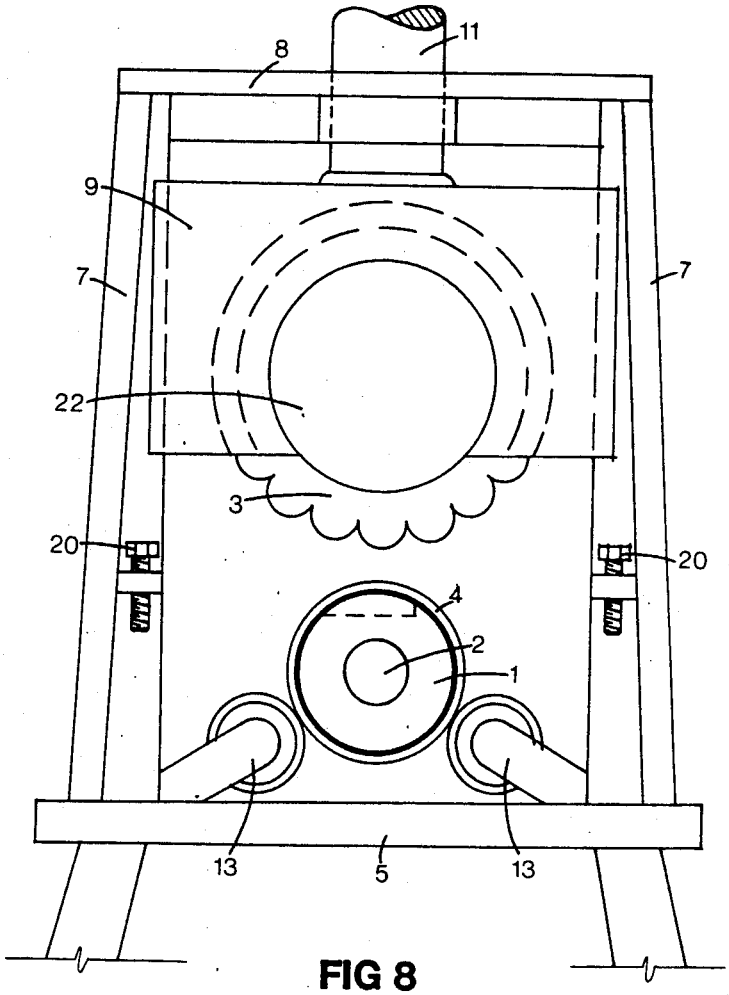
FIG 8

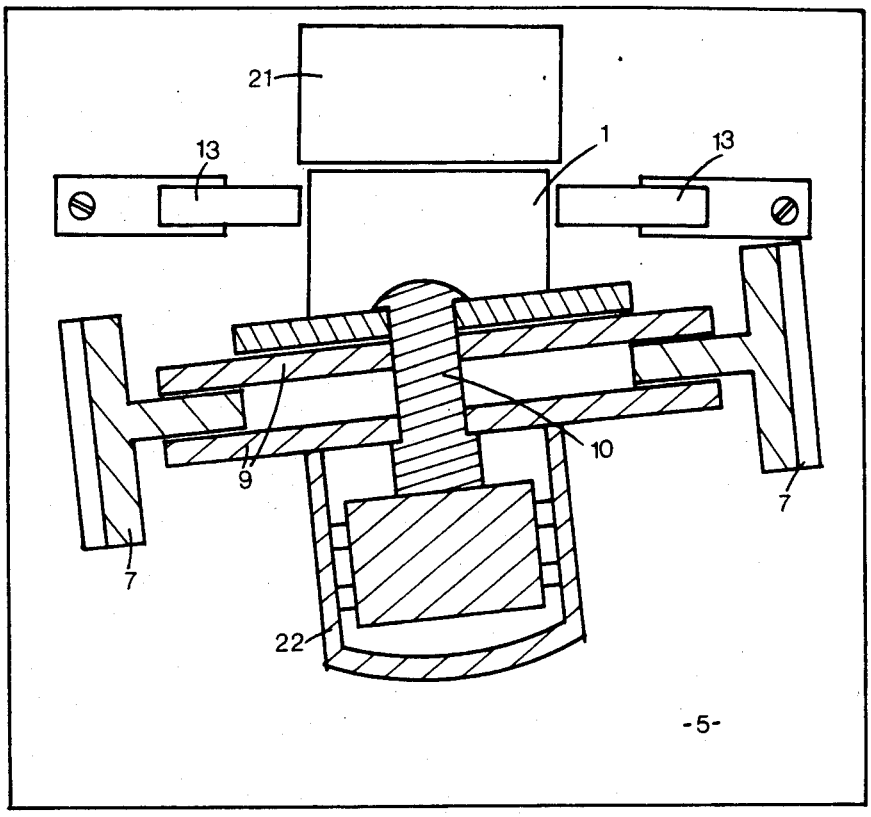
FIG 9
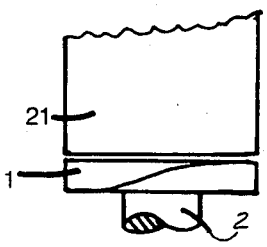
FIG 10
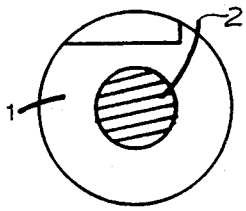

APPARATUS FOR FORMING A BAFFLE

My invention relates to an apparatus for perforating by louvering piping, tubing or the like. The apparatus is particularly suitable for louvering a section of piping to form a baffle for an automobile muffler or silencer.

A variety of apparatus for perforating materials such as metals, plastics and the like by cold stamping are known. Such apparatus typically provide an anvil which may be any one of numerous known forms and against which the work material is placed, so that a stamping means such as a die acting in conjunction with the anvil will cause the work material to be perforated or punctured. The die is typically reciprocating in action, so that after one perforation or puncture has been formed the die retracts, allowing the work material to be further fed through or into the apparatus to expose a fresh portion of the work for perforation. One problem encountered with such apparatus is that the reciprocating die (or dies) can sometimes become jammed. It is also common for the active edges of the die to require regular sharpening.

My invention provides a perforation apparatus which will go at least someway towards overcoming these problems, and it is a particular object of my invention to provide a perforation apparatus particularly suitable for the louvering or forming of a plurality of holes in a section of tubing or piping.

My invention may broadly be said to comprise louvering apparatus suitable for the perforation of tubing or piping, comprising:

support means to support a section of piping such that it is rotatable about its longitudinal axis and driving means to cause said piping to so rotate, a toothed die wheel comprising peripheral die teeth and mounted for rotation such that its teeth may contact and perforate the wall of the piping, the axis of rotation of the toothed wheel being so positioned that the series of perforations formed by the teeth thereof will form a substantially spiral track around the wall of the piping, and means operable to cause the said die wheel to engage the piping.

In one form of the apparatus the die wheel is 'free-wheeling' and the 'driving means' to cause the piping to rotate is a hydraulic motor and associated chuck arranged to grip or otherwise engage an end of the piping and to rotate same. The die wheel is driven by rotation of the piping itself, that it engages, as the piping progresses through the apparatus past the toothed die wheel.

In another form of the apparatus the die wheel is driven directly by the 'driving means'. The piping is rotated by the driven die wheel which it engages as it progresses through the apparatus.

Preferably the apparatus includes an anvil member arranged to co-operate with the toothed die wheel in perforating the piping.

Figure 1:
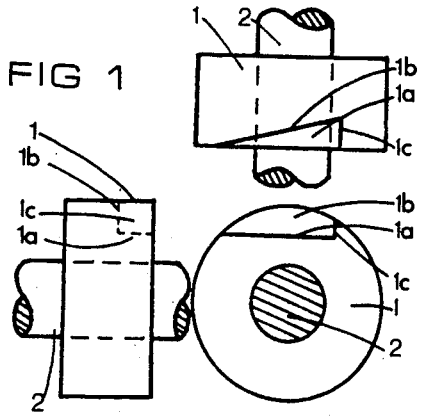
Figure 2:
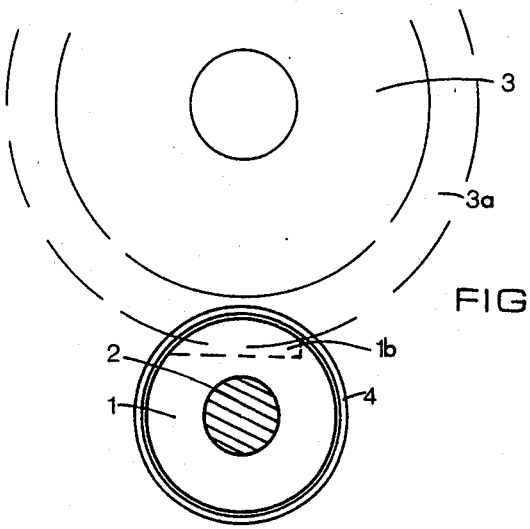
Figure 3:
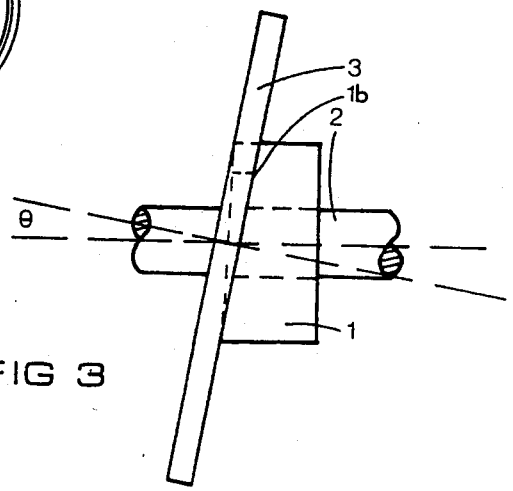
Figure 6:
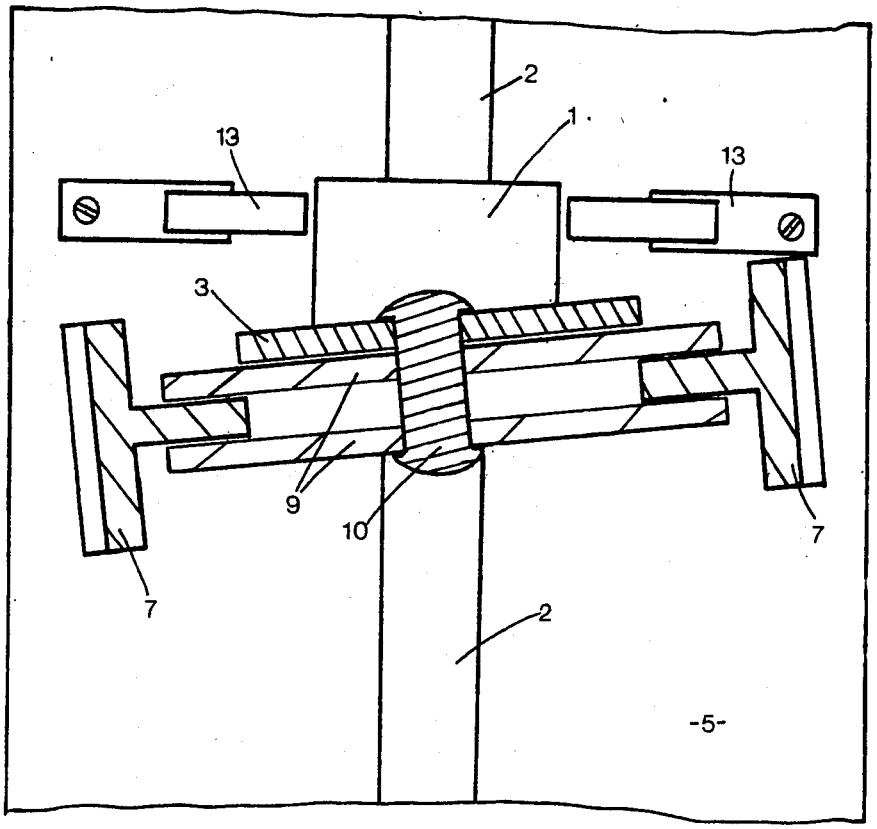

Two preferred forms of the apparatus of my invention are illustrated in the accompanying drawings, wherein:

FIG. 1 is three views of the anvil of the first form apparatus,

FIG. 2 is a schematic view of the interaction of the anvil and the toothed wheel (shown in phantom outline) of the apparatus, FIG. 3 is a schematic plan view of the interaction of the anvil and the toothed wheel of the apparatus, FIG. 4 is a side view of the first form apparatus, in toto, FIG. 5 is an end view of the first form apparatus of FIG. 4 in the direction of arrow A of FIG. 4, FIG. 6 is a cross-sectional view of a part of FIG. 4 through line II—II thereof, FIG. 7 is a side view of the second form apparatus, in toto, FIG. 8 is an end view of the second form apparatus in the direction of arrow B of FIG. 7, FIG. 9 is a cross-sectional view of a part of FIG. 8 through line III—III thereof, and FIG. 10 is two views of the anvil of the second form apparatus.

The first form apparatus is shown in FIGS. 1 to 6 of the drawings. In the first form apparatus the anvil 1 is in the shape of a cylinder fixedly mounted about its longitudinal axis on a longitudinally extending shaft 2 one end of which is fixedly supported and the other end of which is supported as will be described. Formed in the upper portion of the anvil 1 is a wedge shaped step having a horizontal floor 1*a* and a vertical back wall 1*b*. This step may extend right across the side face of the anvil 1 as a chord or may stop short in a side wall 1*c*. The back wall 1*b* comprises the operative anvil face and it extends at an angle to the diameter of the shaft 2.

This die wheel of the first form apparatus is indicated at 3. FIGS. 2 and 3 show the interaction of the die wheel 3 with the anvil 1. The die wheel 3 itself comprises a circular plate having a series of peripheral teeth 3*a*. The die wheel 3 is mounted for rotation such that its teeth may contact and serially perforate the wall of piping to be perforated. The axis of rotation of the die wheel 3 is offset from the common axis of the anvil 1 and shaft 2, such that the teeth of the die wheel 3 are substantially coplanar with the operative anvil face 1*b* of the anvil 1 as shown. The die wheel teeth 3*a* are so spaced about the periphery of the die wheel that one tooth at a time will register with the step of the anvil 1 and the operative anvil face 1*b*. It can be seen that if a section of piping 4 is fed into the rotating die wheel 3 by sliding the piping over the anvil 2, the piping 4 will be louvered by the shearing action of the die wheel 3 against the operative anvil face 1*b* of the anvil 1.

FIGS. 4, 5 and 6 show the first form apparatus in toto. The apparatus comprises a rectangular bed 5. Upstanding from and bridging the long sides of the bed 5 at one end is a support frame generally indicated at 6 which provides a mounting for the die wheel 3. The support frame comprises two vertical members 7 upstanding from either side of the bed and connected at their upper ends by a bridge member 8. A slidable sandwich plate 9 spans between the two vertical members 7, which are T-shaped in cross-section, below the bridge member 8 as shown and an axle 10 extends outwardly from the slidable plate 9 to provide an axis of rotation for the die wheel 3. A small angle of offset from normal is provided between the longitudinal axis of the shaft 2 and anvil 1 and the axis of rotation of the toothed wheel 3 as hereinbefore described. The vertical members 7 are displaced so that axis of rotation of the die wheel 3 is positioned at an angle to the shaft 2, and the direction of travel of the piping as will be described. The angle of offset is adjusted as desired. The support frame 6 may alternatively be mounted on a separate base plate rotatably positioned on the bed 5 so that the angle of offset may be varied by rotating the entire support frame.

The arrangement of the slidable sandwich plate 9 and vertical members 7 comprises a reciprocably movable support for the die wheel 3. A connecting rod 11 connects the slidable plate 9 to a hydraulic ram 12 which can be operated to move the die wheel between a first position wherein the die wheel engages piping to perforate same, and a second position (shown in the drawings) wherein the die wheel is clear of the piping. Suitable means to limit downward movement is provided as adjustable stop bolts 20 threaded into suitable portions of the vertical members 7 as shown.

Driving means is provided to rotate the piping 4 about the shaft 2 and anvil 1, and in the first form apparatus this means comprises a hydraulic drive unit or chuck 15 mounted on the shaft 2 opposite the support frame 6 and adapted to grip one end of the piping 4. The drive unit 15 is slidable longitudinally along the shaft 2 such that it will be drawn along the shaft 2 towards the support frame by the interaction of the rotating piping 4 which it grips, and the toothed wheel 3. Additional support means for the piping and anvil are provided by bearing supports comprising rollers 13 upstanding from the bed 5. These rollers contact the exterior of the piping and assist in supporting same during perforation. In conjunction with the toothed wheel 3 they form a three point mount for the piping 4.

In use of the first form apparatus a section of piping 4 is fed into the machine by sliding the piping over the exposed end of the shaft 2, over the anvil 1 and until the distal end of the piping engages into and is gripped by the drive unit 15. The drive unit 15 is then activated causing the piping 4 to rotate and the ram 12 is also activitated so as to cause the slidable plate and die wheel mounted thereon to move downwardly toward the rotating piping and to its first position wherein it engages therewith, so that the die wheel 3 in conjunction with the anvil 1 will louvre the piping as hereinbefore described. As the die wheel 3 rolls along the circumference of the piping 4, the louvred piping 4 is drawn past the die wheel and the drive unit 15 is drawn along the shaft 2 towards the support frame 6. As the drive unit 15 approaches the support frame 6 the drive unit 15 trips a micro switch (not shown in the drawings) or the like so as to deactivate the drive unit 15 and prevent further operation of the apparatus. The finished piece of piping 4 is then removed.

The second form of apparatus illustrated in FIGS. 7 to 10 (wherein like reference numerals designate like parts) is similar to the first form apparatus but embodies significant differences. The anvil 1 is of a different shape and the driving means for the piping is connected directly to the die wheel to drive same and the piping thereby.

The drive unit 15 is replaced by a drive unit 22 positioned as shown and connected directly to the die wheel 3. The die wheel 3 is driven and itself causes the piping being perforated to rotate. With this arrangement significantly less power is required from the drive unit and this is advantageous because tooth wear and energy consumption are reduced.

The anvil 1 is smaller, and of a different size and a cylindrical support member 21 is also provided adjacent the anvil 1 as shown to assist in supporting the section of piping. This support member 21 is mounted on the shaft 2 by way of suitable bearings such as ball or roller bearings so that it will provide a rotating support for piping being perforated, thus further reducing friction. This contributes to the reduction in motor power required as referred to above.

The actual anvil 1 in the second form apparatus is smaller (lengthwise) than the anvil in the first form apparatus (although the arrangement described could be employed with the first form apparatus) and is in what may be described as a wedge form, as can be seen from FIG. 10. The anvil is required only to provide an operative anvil face to cooperate with the toothed wheel 3 and does not support the piping (the support 21 does) and it need therefore not be large but can be small and wedge shaped as shown.

The foregoing describes my invention including preferred forms thereof. Alterations and modifications as will be obvious to those skilled in the art are intended to be incorporated within the scope hereof, which is defined in the following claims.

I claim:

1. A louvering apparatus for the perforation of tubing or piping, comprising;

support means adapted to support a section of piping whereby it is rotatable about its longitudinal axis, including a support member positionable within said piping of a diameter similar to the internal diameter of the said piping and rotatably mounted to form an internal support for said piping whereby said support member may enter said piping to support same from within during said perforation;

driving means to cause said piping to rotate;

a toothed die wheel comprising peripheral die teeth and mounted for rotation such that its teeth may contact and perforate the wall of the piping, the axis of rotation of the toothed die wheel being so positioned that the series of perforations formed by the teeth thereof will form a substantially spiral track around the wall of the piping;

means operable to cause the said die wheel to engage the piping to effect said perforation; and an anvil member arranged to co-operte with the said toothed die wheel in perforating said piping and having an operative anvil face that extends at an angle to the longitudinal axis of the said piping when same is supported by said support means and that is substantially coplanar with a face of the teeth of the said die wheel.

2. A louvering machine as claimed in claim 1, wherein said support means is substantially circular in cross-section transverse to the longitudinal axis of said piping during perforation.

3. A louvering apparatus as claimed in claim 2, wherein said support means additionally includes bearing supports arranged to contact the exterior of the said piping to assist in supporting same during perforation.

4. A louvering apparatus as claimed in claim 3, wherein said support member and said anvil member are mounted to one end of a longitudinally extending shaft which is fixedly supported at its other end and wherein said bearing supports said piping from below, adjacent said support member at said one end.

5. A louvering apparatus as claimed in any of claims 1 to 4, wherein said die wheel is mounted to a reciprocably movable support whereby said die wheel is movable between a first position wherein said die wheel can engage said piping and a second position wherein said die wheel is clear of said piping.

6. A louvering apparatus as claimed in any of claims 1 to 4, wherein said die wheel is mounted to a reciprocably movable support whereby said die wheel is movable between a first position wherein said die wheel can engage said piping and a second position wherein said die wheel is clear of said piping, and wherein said driving means is connected to said die wheel to drive same and said piping thereby.

7. A louvering apparatus for the perforation of tubing or piping, comprising:

an anvil member positionable internally of said piping and a rotatably mounted support member arranged to support and form an internal bearing for said piping whereby same is rotatable about its longitudinal axis about said anvil member;

a toothed die wheel comprising peripheral die teeth and mounted for rotation such that its teeth may contact and together with an operative face of said anvil member with which said teeth co-operate perforate the wall of the piping, the axis of rotation of the toothed wheel being so positioned that the series of perforations formed by the teeth thereof will form a substantially spiral track around the wall of the piping;

driving means connected to said die wheel to drive same and to cause said piping to rotate; and a reciprocably movable support for said die wheel whereby said die wheel is movable between a first position wherein said die wheel can engage said piping and a second position wherein said die wheel is clear of said piping.

* * * * *